US005668924A

United States Patent [19]

Takahashi

[11] Patent Number: 5,668,924

[45] Date of Patent: Sep. 16, 1997

[54] DIGITAL SOUND RECORDING AND REPRODUCTION DEVICE USING A CODING TECHNIQUE TO COMPRESS DATA FOR REDUCTION OF MEMORY REQUIREMENTS

[75] Inventor: Hidetaka Takahashi, Hachioji, Japan

[73] Assignee: Olympus Optical Co. Ltd., Tokyo, Japan

[21] Appl. No.: 534,362

[22] Filed: Sep. 27, 1995

[30] Foreign Application Priority Data

Jan. 18, 1995 [JP] Japan ..... 7-005948
Jan. 30, 1995 [JP] Japan ..... 7-012878

[51] Int. Cl.[6] ..... G10L 9/14

[52] U.S. Cl. ..... 704/219; 704/201; 704/258; 704/262; 704/265; 704/270

[58] Field of Search ..... 395/2.1, 2.23, 395/2.28, 2.34, 2.67, 2.71, 2.74, 2.79, 2.91–2.95

[56] References Cited

U.S. PATENT DOCUMENTS 4,868,867 9/1989 Davidson et al. ..... 395/2.39
5,457,783 10/1995 Harprit ..... 395/2.28
5,495,555 2/1996 Swaminathan ..... 395/2.16

*Primary Examiner*—Allen R. MacDonald
*Assistant Examiner*—Alphonso A. Collins
*Attorney, Agent, or Firm*—Kenyon & Kenyon

[57] ABSTRACT

A sound recording and reproducing device codes a sound signal by a code excited linear predictive coding means including an adaptive code book created on the basis of past excitation signals, a stochastic code book having a plurality of different stochastic signals and a pulse code book having a plurality of pulse signals. When decoding the sound data coded frame by frame by code excited linear predictive coding, each frame comprising a plurality of sub-frames, by using an adaptive code book created on the basis of a past excitation signal, and a stochastic code book having a plurality of different stochastic signals, a switch controller controls switches such that the coded data in a predetermined sub-frame of each frame is skipped in accordance with the rate of change of reproduction speed to decode the coded data in the remaining sub-frame or sub-frames without decoding the coded data in the skipped sub-frame, and the contents of the adaptive code book are renewed.

10 Claims, 11 Drawing Sheets

| SUB-FRAME | 1 | 2 | 3 | 4 |
|---|---|---|---|---|
| SWITCH 72 | b | b | b | b |
| SWITCH 77 | ON | ON | ON | ON |
| SWITCH 79 | ON | ON | ON | OFF |

FIG. 10 (a)

| SUB-FRAME | 1 | 2 | 3 | 4(1st) | 4(2nd) |
|---|---|---|---|---|---|
| SWITCH 72 | b | b | b | b | a |
| SWITCH 77 | ON | ON | ON | ON | OFF |
| SWITCH 79 | ON | ON | ON | ON | ON |

FIG. 10 (b)

| RATE OF CHANGE OF REPRODUCTION SPEED | 2 | 4/3 | 1 | 4/5 | 4/6 | 4/7 | 4/8 |
|---|---|---|---|---|---|---|---|
| SKIPPED SUB-FRAME No. | 3,4 | 4 | - | - | - | - | - |
| REPEATEDLY READ SUB-FRAME No. | - | - | - | 4 | 3,4 | 2,3,4 | 1,2,3,4 |

FIG. 11

DIGITAL SOUND RECORDING AND REPRODUCTION DEVICE USING A CODING TECHNIQUE TO COMPRESS DATA FOR REDUCTION OF MEMORY REQUIREMENTS

FIELD OF THE INVENTION

The present invention relates to a sound recording and reproducing device.

BACKGROUND INFORMATION

Recently, a digital information recording and reproducing device, which is a so-called digital recorder, has been developed. This device is able to convert a sound signal obtained by a microphone or the like to a digital signal and record it in a memory such as an IC memory. When reproducing the sound signal, the device reads the digital signal from the memory and converts it to an analog signal to output it from an output means such as a speaker.

In such a digital information recording and reproducing device, a coding technique to compress the volume of data efficiently for saving the space of the memory is applied to reduce a volume of data as little as possible. A method of code excited linear predictive coding with an adaptive code book is widely adopted as a highly efficient data compressing technique. This method is recognized as being able to obtain reproduced sounds of comparatively high quality at a bit rate of 8 kbps. Therefore, many applications of the method have been developed, especially, in the field of digital mobile communication.

In the digital information recording and reproducing device, a reproduced position is defined by designating an address for the memory. For instance, a change of the reproduced position by skipping forward (selecting forward address: FF Mode), skipping backward (selecting a backward address: REW Mode) or repeating (selecting the same address repeatedly after a period of time: Repeat Mode) is completed by the counting operation of an address counter.

However, the adaptive code book is created based on the past excitation signal. Therefore, when the reproduced position is changed, the contents of the adaptive code book would not be related to those of the adaptive code book created based on the new excitation signal at the changed position so that a strange sound is produced. Hence, there is the problem that quality of the reproduced sound is poor.

If the contents of the adaptive code book are cleared in accordance with the change of the reproduced position, the strange sounds will be less produced. However, when the reproduced position is on a constant part of voiced sound, a pulse signal of the voiced sound cannot be formed. Hence, the quality of the reproduced sound becomes poor.

Further, the above described sound recording and reproducing device is also used in the fields of the study of foreign languages or dictation. In such applications, it is desirable to be able to vary the speed of reproduction. As an example, Japanese Laid-Open Patent Application Publication No. Hei 2-93700 discloses a device.

Japanese Laid-Open Patent Application Publication No. Hei 2-93700 discloses a sound decoding device using multi-pulse speech coding and decoding with pitch prediction. When making the speed slow, the device extends a frame length corresponding to a ratio of the change of reproduction speed and supplements the excitation signal in the extended part of the frame with null elements. When making the speed fast, the device reduces the frame length corresponding to a ratio of the change of reproduction speed and discards the remainder part. Thus, the reproduction speed can be changed only by making little additional changes to the sound decoding device.

However, the sound decoding device disclosed in Japanese Laid-Open Patent Application Publication No. Hei 2-93700 only changes the frame length at the time of decoding, so that the reproduced sound becomes very hard to listen to because of an improper interval of the reproduced sound.

SUMMARY OF THE INVENTION

A first object of the present invention is to provide a sound recording and reproducing device to obtain a reproduced sound of high quality, even though a reproduced position is changed to any position.

To achieve the first object, a sound recording and reproducing device according to the present invention performs coding or decoding of an excitation signal by a means for code excited linear predictive coding and decoding including an adaptive code book created on the basis of past excitation signals, a stochastic code book comprised of a set of stochastic signals and a pulse code book having a plurality of different pulse signals.

A second object of the present invention is to provide, by slightly modifying a conventional decoding device, a sound reproducing device which is able to change the reproduction speed of sound with a natural interval maintained.

In order to achieve the second object, a sound reproducing device according to the present invention uses an adaptive code book created on the basis of past excitation signals and a stochastic code book having a plurality of different stochastic signals to decode sound data coded frame-by-frame by code excited linear predictive coding, each frame comprising a plurality of sub-frames. The sound reproducing device comprises a control means for skipping the coded data in a predetermined sub-frame of each frame in accordance with the rate of change of the reproduction speed to decode the coded data in the remaining sub-frame or sub-frames without decoding the coded data in the skipped sub-frame, and for renewing the adaptive code book, when the reproduction speed is increased.

BRIEF DESCRIPTION OF THE DRAWINGS

FIG. 9(*b*) is an illustration for explaining a decoding process when the reproduction speed is increased.

FIG. 9(*c*) is an illustration for explaining a decoding process when the reproduction speed is decreased.

FIG. 10(*a*) is a table which shows the condition of each switch when the reproduction speed is increased.

FIG. 10(*b*) is a table which shows the condition of each switch when the reproduction speed is decrease.

FIG. 11 is a table which shows the sub-frames whose coded data are skipped or repeatedly read out in accordance with the rate of change of the reproduction speed.

DETAILED DESCRIPTION

Figure 1:
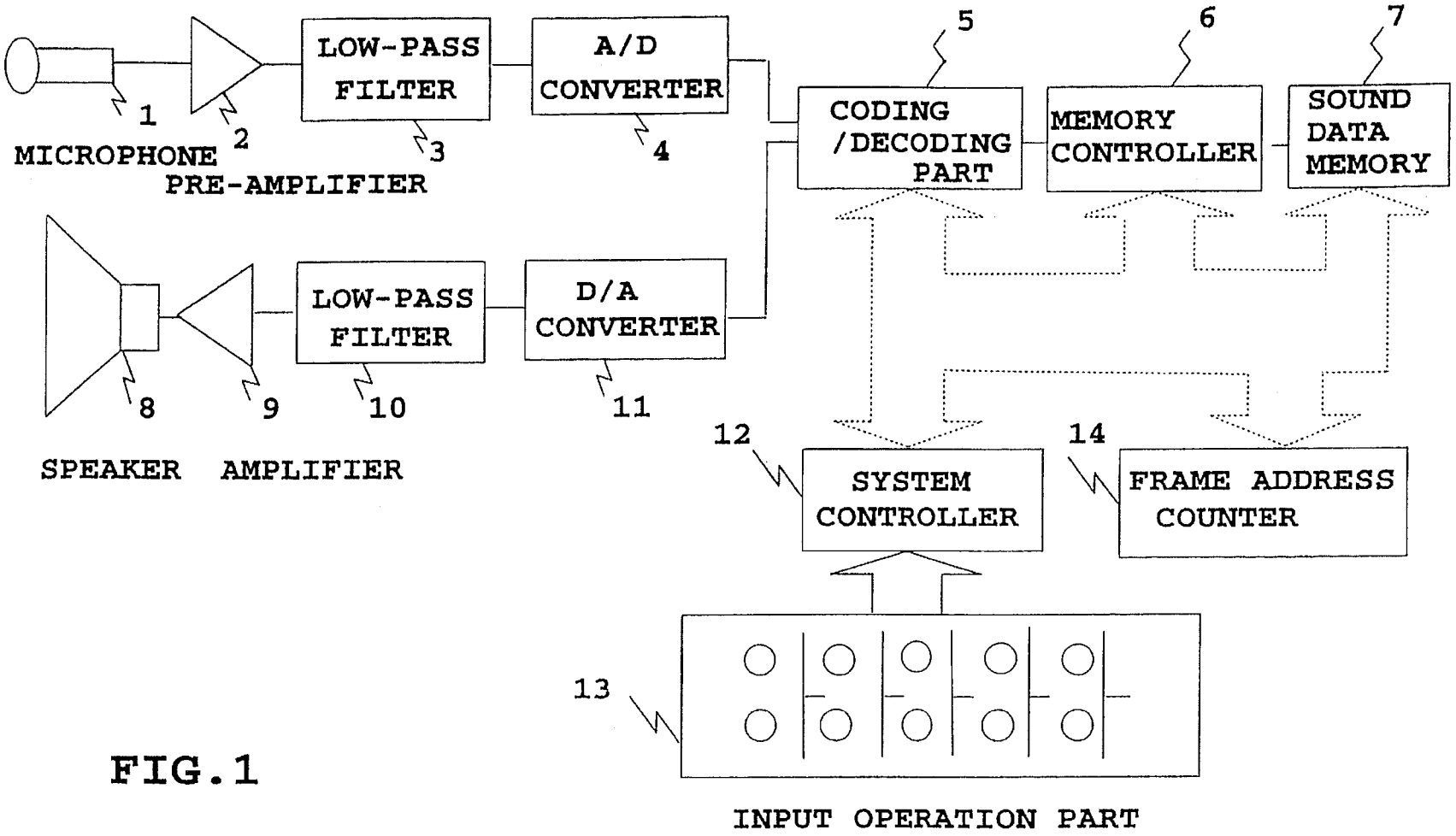
FIG. 1 is a block diagram which shows a structure of a digital recorder to which the present invention is applied.

Referring to the drawings, an embodiment of the present invention is explained in detail.

FIG. 1 is a block diagram which shows a structure of a digital recorder to which the present invention is applied. In FIG. 1, a microphone 1 is coupled to a first terminal of a coding/decoding part 5 through a pre-amplifier 2, a low-pass filter 3 and an analog-to-digital converter 4. A speaker 8 is coupled to a second terminal of the coding/decoding part 5 through a power amplifier 9, a low-pass filter 10 and a digital-to-analog converter 11. A third terminal of the coding/decoding part 5 is coupled to a sound data memory 7 through a memory controller 6. A system controller 12 is connected with and controls the coding/decoding 5, the memory controller 6, an input operation part 13, a frame address counter 14 and the sound data memory 7. The input operation part 13 includes the operation buttons for recording, reproducing, stopping, skipping forward or skipping backward or the like, and outputs an operation signal to the system controller 12 when each operation button is pushed.

In the above described structure, when the button of the input operation part 13 is pushed by a user, a recording operation will be started. Then, an input sound signal is converted to an electric signal by the microphone 1. The electric signal from the microphone 1 is amplified by the pre-amplifier 2. An unnecessary high-frequency component which is included in the electric signal output from the microphone 1 is filtered by the low-pass filter 3. Since an output signal from the low-pass filter 3 is an analog signal, the signal is converted to a digital signal by the analog-to-digital converter 4. The digital signal is coded and the coded data is then output by the coding/decoding part 5. The coded data is stored in the sound memory 7 through the memory controller 6.

During the sound reproduction process, the coded data is read from the sound memory 7 and supplied to the coding/decoding part 5 through the memory controller 6. The coded data is decoded and the sound data is output by the coding/decoding part 5. Since the decoded data is a digital signal, the decoded data is converted to an analog signal by the digital-to-analog converter 11. An unnecessary high-frequency component which is included in the analog signal output from the digital-to-analog converter 11 is filtered by the low-pass filter 10. The analog signal output from the low-pass filter 10 is amplified by the power amplifier 9 and the amplified signal is reproduced as sound by the speaker 8.

During the above sequential processes, the memory controller 6 controls an operation of the input/output of signals transmitted between the sound memory 7 and the coding/decoding part 5.

The frame address counter 14 performs a counting operation according to a given frame address data from the system controller 12 and specifies a frame address for the sound data memory 7.

Next, the details of the coding process of the coding/decoding part 5 are described.

Figure 4:
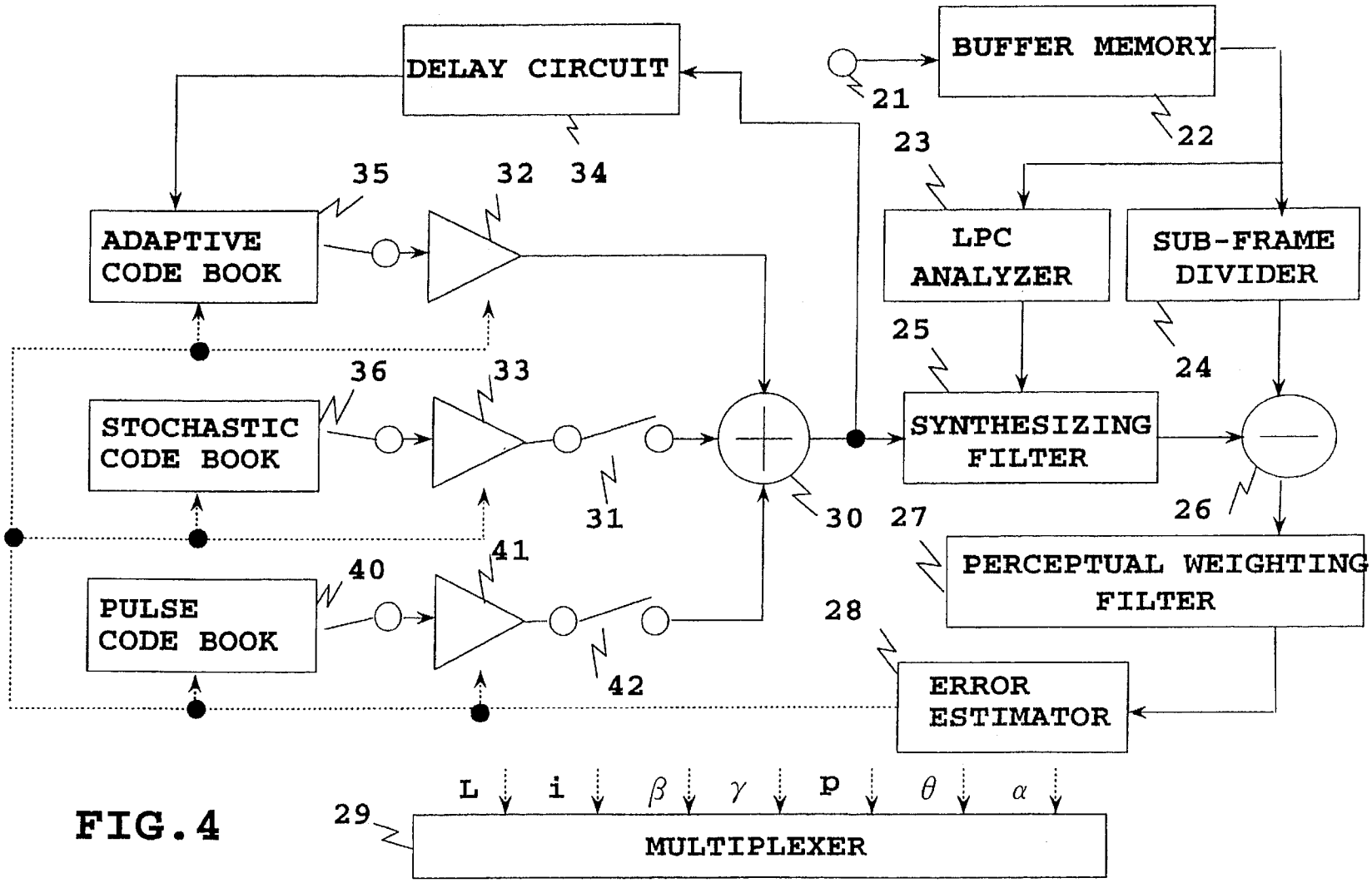
FIG. 4 is a block diagram which shows a structure of a code excited linear predictive coding device.

FIG. 4 is a block diagram which shows a structure of a code excited linear predictive coding device having an adaptive code book. In FIG. 4, an adaptive code book 35 is coupled to a first input terminal of an adder 30 through a multiplier 32. A stochastic code book 36 is coupled to a second input terminal of the adder 30 through a multiplier 33 and a switch 31. A pulse code book 40 is coupled to a third input terminal of the adder 30 through a multiplier 41 and a switch 42. An output terminal of the adder 30 is coupled to a first input terminal of a subtracter 26 through a synthesizing filter 25 and is also coupled to the adaptive code book 35 through a delay circuit 34.

A buffer memory 22, which is connected to an input terminal 21, is coupled to the synthesizing filter 25 through a linear predictor 23. The buffer memory 22 is also coupled to a second terminal of the subtracter 26 through a sub-frame divider 24. An output terminal of the subtracter 26 is coupled to an input terminal of an error estimator 28 through a perceptual weighting filter 27. An output terminal of the error estimator 28 is connected with the adaptive code book 35, the stochastic code book 36, the pulse code book 40 and the multipliers 32, 33 and 41.

Furthermore, a multiplexer 29 is connected with the linear predictor 23 and the error estimator 28.

In the above described structure, for example, an original sound signal sampled at 8 KHz is input from the input terminal 21 and stored in the buffer memory 22 at the predetermined frame intervals (for example 20 ms, that is, 160 samples). The buffer memory 22 transmits the original sound signal to the linear predictor 23 frame-by-frame. The linear predictor 23 performs a linear predictive coding on the original sound signal, obtains a parameter $\alpha$ representing spectral characteristics and transmits the parameter to the synthesizing filter 25 and the multiplexer 29. The sub-frame divider 24 divides the original sound signal in a frame at predetermined sub-frame intervals (for example, 5 ms, that is, 40 samples). As such, sub-frame signals in four sub-frames from the first to the fourth are created from the original sound signal in the frame.

Both a delay L and a gain $\beta$ of the adaptive code book 35 are determined by the following process.

First, the delay circuit 34 gives a delay which is equal to a period of pitch to an excitation signal in a preceding sub-frame to be input to the synthesizing filter 25, and creates an adaptive code vector. For example, if the pitch period is assumed to be 40–167 samples, the 128 kinds of signals delayed for 40–167 samples are created as the adaptive code vectors and saved into the adaptive code book 35. At this time, the switches 31 and 42 are open. Therefore, each adaptive code vector is input to the synthesizing filter 25 through the adder 30 after being multiplied by a predetermined gain value at the multiplier 32. The gain value is varied in accordance with each adaptive code vector. Using parameters of linear prediction, the synthesizing filter 25 carries on a synthesizing process and transmits a synthesized vector to the subtracter 26. The subtracter 26 subtracts the synthesized vector from the original sound vector. The resultant error vector is then transmitted to the perceptual weighting filter 27. Considering characteristics of listening sensitivity, the perceptual weighting filter 27 carries out a perceptual weighting process to the error vector and transmits it to the error estimator 28. The error evaluator 28 minimizes the error power, searches the adaptive code vector for which the error power is minimized and transmits its delay L and gain β to the multiplexer 29. In this way, the delay L and the gain β of the adaptive code book 35 are determined.

Second, an index i and a gain γ of the stochastic code book 36 are determined by the following process.

Stochastic vectors of the dimensions (for example 512 kinds) corresponding to the length of the sub-frame are initially saved in the stochastic code book 36 and an index is assigned to each vector. During the process, the switch 31 is open.

The best adaptive code vector determined by the above process is transmitted to the adder 30 after being multiplied by the best gain β at the multiplier 32.

Then, each stochastic vector is input to the adder 30 after being multiplied by a predetermined value of gain at the multiplier 33. The value of gain is varied according to each stochastic vector. The adder 30 adds the best adaptive code vector multiplied by the best gain β to each stochastic code vector. The result of the adding operation is then input to the synthesizing filter 25. The process after this process is completed in the same way as the determination process for the parameters of the adaptive code book. Namely, using parameters of linear prediction, the synthesizing filter 25 carries out a synthesizing process and transmits a synthesized vector to the subtracter 26. The subtracter 26 subtracts the synthesized vector from the original sound vector and transmits an obtained error vector to the perceptual weighting filter 27. Considering characteristics of listening sensitivity, the perceptual weighting filter 27 carries out an operation of perceptual weighting to the error vector and transmits the vector to the error estimator 28. The error estimator 28 minimize the error power, searches the stochastic vector for which the error power is minimized and transmits its index i and gain γ to the multiplexer 29. In this way, the index i and the gain γ of the stochastic code book 36 are determined.

Third, an index p and a gain θ of the pulse code book 40 are determined by the following process.

Figure 6:
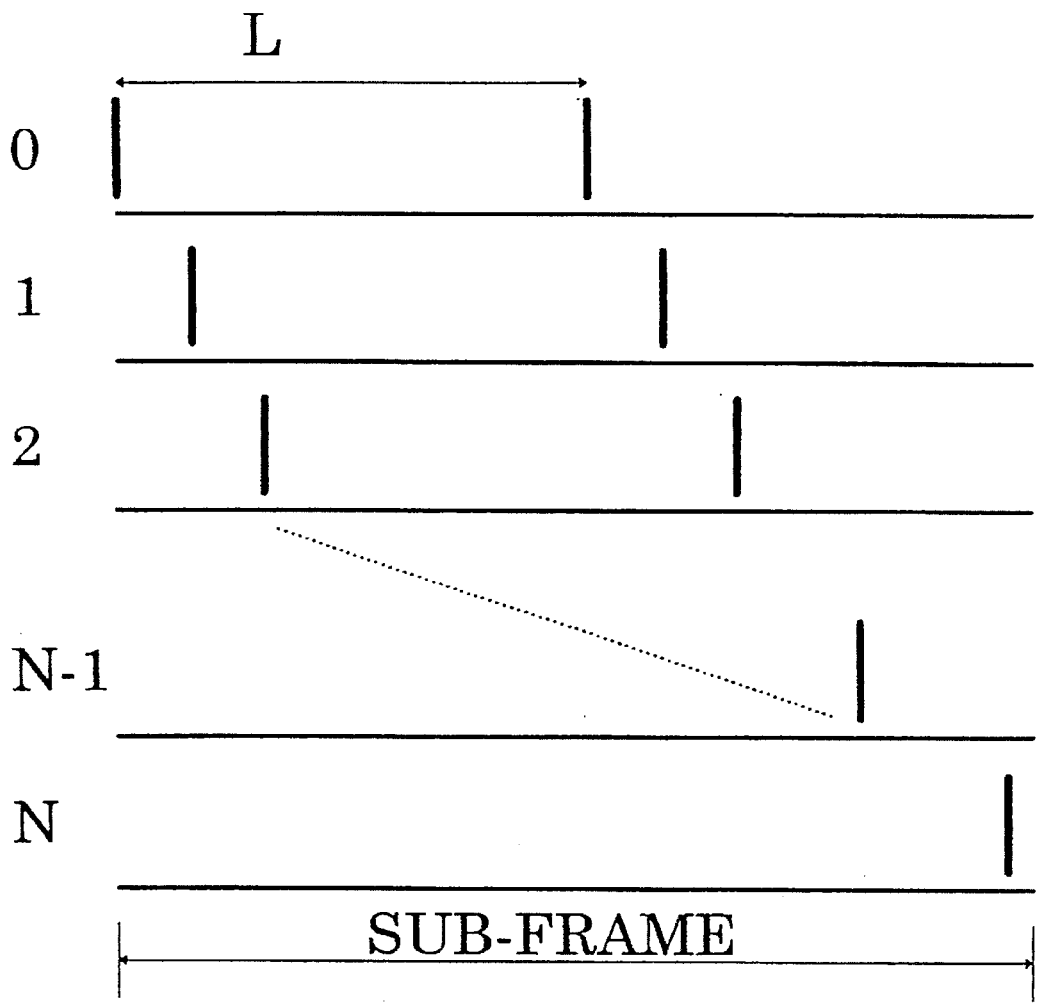
FIG. 6 is an illustration for explaining a determination method of an index p and a gain θ for a pulse code book.

As shown in FIG. 6, pulse signals are generated at an interval for the delay L which was obtained by the search of the adaptive code book, and signals sequentially delayed by a predetermined number of sample or samples, for example 1, are created as respective pulse code vectors and stored in the pulse code book 40. Each pulse code vector is given an index. In this process, switches 31 and 42 are closed.

The best adaptive code vector determined in the previous process is transmitted to the adder 30 after being multiplied by the best gain β at the multiplier 32. The best stochastic code vector which was determined in the previous process is transmitted to the adder 30 after being multiplied by the best gain γ.

Each pulse code vector is transmitted to the adder 30 after being multiplied by a predetermined value of gain at the multiplier 41. The gain value is varied according to each pulse code vector. The adder 30 adds the best adaptive code vector which was multiplied by the best gain β, the best stochastic code vector multiplied by the best gain γ and each pulse vector. The result of the adding operation is input to the synthesizing filter 25. The process after this process is completed in the same way as the previous process to determine the parameters of the stochastic process. Namely, using parameters of linear prediction, the synthesizing filter 25 carries out a synthesizing process and transmits a synthesized vector to the subtracter 26. The subtracter 26 subtracts the synthesized vector from the original sound vector and transmits an obtained error vector to the perceptual weighting filter 27. Considering characteristics of listening sensitivity, the perceptual weighting filter 27 carries the process of perceptual weighting to the error vector and transmits the vector to the error estimator 28. The error estimator 28 minimizes the error power and searches the pulse code vector for which the error power is minimized and transmits its index p and gain θ to the multiplexer 29. In this way, the index p and the gain θ of the pulse code book 40 are determined.

The multiplexer 29 multiplexes and transmits the quantified parameter α of linear prediction, the delay L and the gain β of the adaptive code book 35, the index i and gain γ of the stochastic code book 36 and the index p and gain θ of the pulse code book 40 to the sound memory 7 through the memory controller 6, which is shown in FIG. 1.

Figure 5:
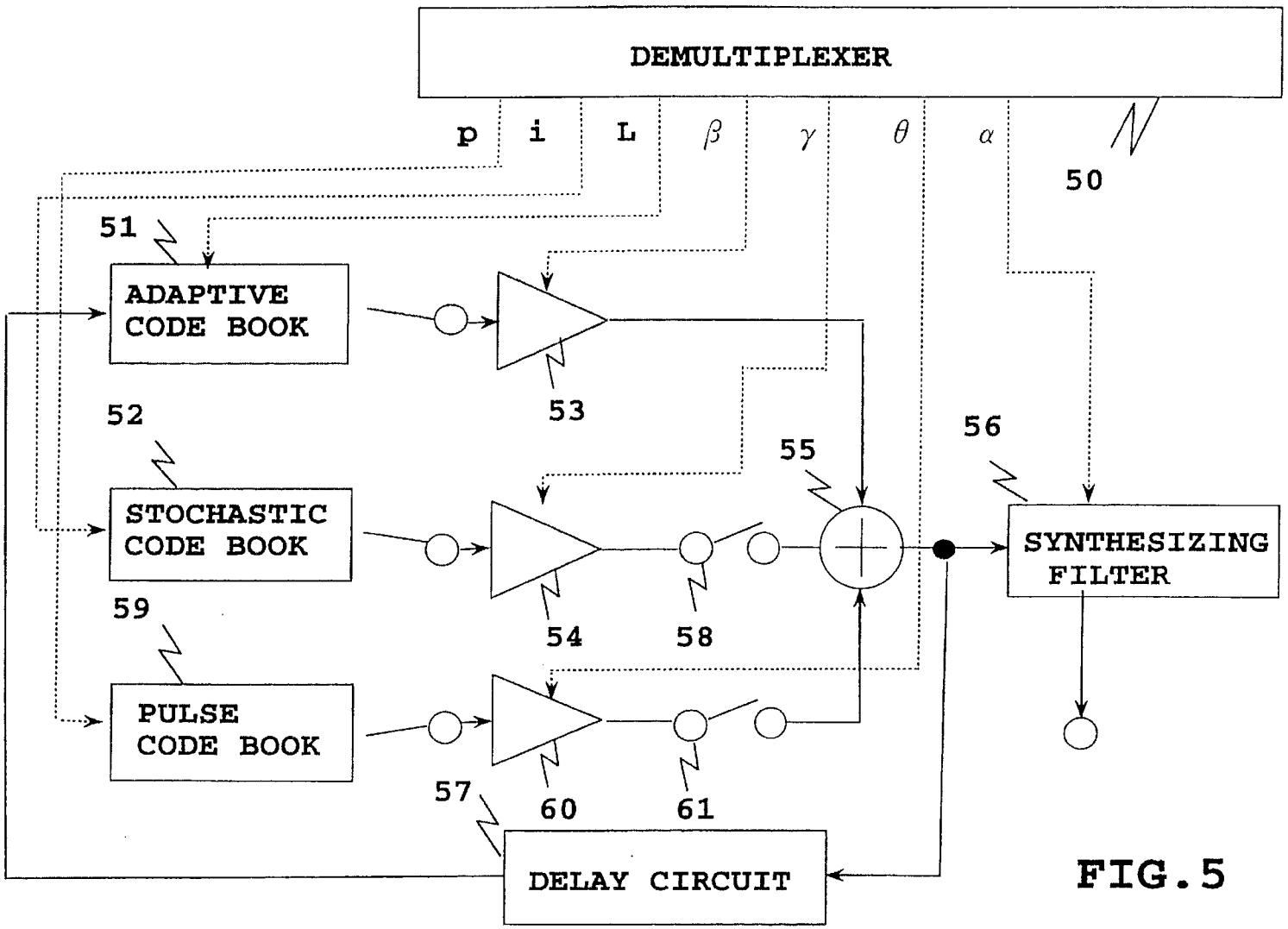
FIG. 5 is a block diagram which shows a structure of a code excited linear predictive decoding device.

Then, the details of the decoding operation at the coding/decoding part 5 are described. FIG. 5 is a block diagram of a decoding device corresponding to the code excited linear predictive coding device in FIG. 4. In FIG. 5, an adaptive code book 51 is coupled to a first input terminal of an adder 55 through a multiplier 53. A stochastic code book 52 is coupled to a second input terminal of the adder 55 through a multiplier 54 and a switch 58. A pulse code book 59 is coupled to a third input terminal of the adder 55 through a multiplier 60 and a switch 61. An output terminal of the adder 55 is connected to a synthesizing filter 56 and is also coupled to the adaptive code book 51 through a delay circuit 57.

A demultiplexer 50 is connected with the adaptive code book 51, the stochastic code book 52, the pulse code book 59, the multipliers 53, 54 and 60 and the synthesizing filter 56.

In FIG. 5, the demultiplexer 50 decomposes a received signal into a parameter α of linear prediction, a delay L and a gain β of the adaptive code book 51, an index i and a gain γ of the stochastic code book 52, and an index p and a gain θ of the pulse code book 59. The obtained parameter α of the linear prediction is output to the synthesizing filter 56. The delay L is output to the adaptive code book 51. The gain β is output to the multiplier 53. The index i is output to the stochastic code book 52. The gain γ is output to the multiplier 54. The index p is output to the pulse code book 59. The gain θ is output to the multiplier 60. Then, based on the delay L of the adaptive code book 51 which was output from the demultiplexer 50, a code vector of the adaptive code book 51 is selected. The adaptive code book 51 has the same contents as the adaptive code book 35 of the coding device. The past excitation signal is input to the adaptive code book 51 through the delay circuit 57. Using the received gain β, the multiplier 53 amplifies the input adaptive code vector and transmits it to the adder 55. Next, based on the index i of the stochastic code book 52 which was output from the demultiplexer 50, the code vector of the stochastic code book 52 is then selected. The stochastic code book 52 has the same contents as the stochastic code book 36 of the coding device. Using the received gain γ, the multiplier 54 amplifies the input stochastic code vector and transmits it to the adder 55. Then, based on the index p of the pulse code book 59 which was output from the demultiplexer 50, the code vector of the pulse code book 59 is selected. The pulse code book 59 has the same contents as the pulse code book 40 of the coding device. Using the received gain θ, the multiplier 60 amplifies the input pulse code vector and transmits it to the adder 55.

The adder 55 adds the amplified pulse code vector, the amplified stochastic code vector and the amplified adaptive code vector and transmits the added vector to the synthesizing filter 56 and the delay circuit 57.

Using the received parameter α of the linear prediction, the synthesizing filter 56 implements a synthesizing operation and outputs a synthesized sound signal.

Referring to flow charts in FIG. 2 and FIG. 3, an operation of the system controller 12 according to the embodiment of the present invention will now be described.

Here is described an operation of the system controller 12 when a user performs the operation of the REW mode, stops the REW mode at a certain position and implements the operation of reproduction.

Figure 2:
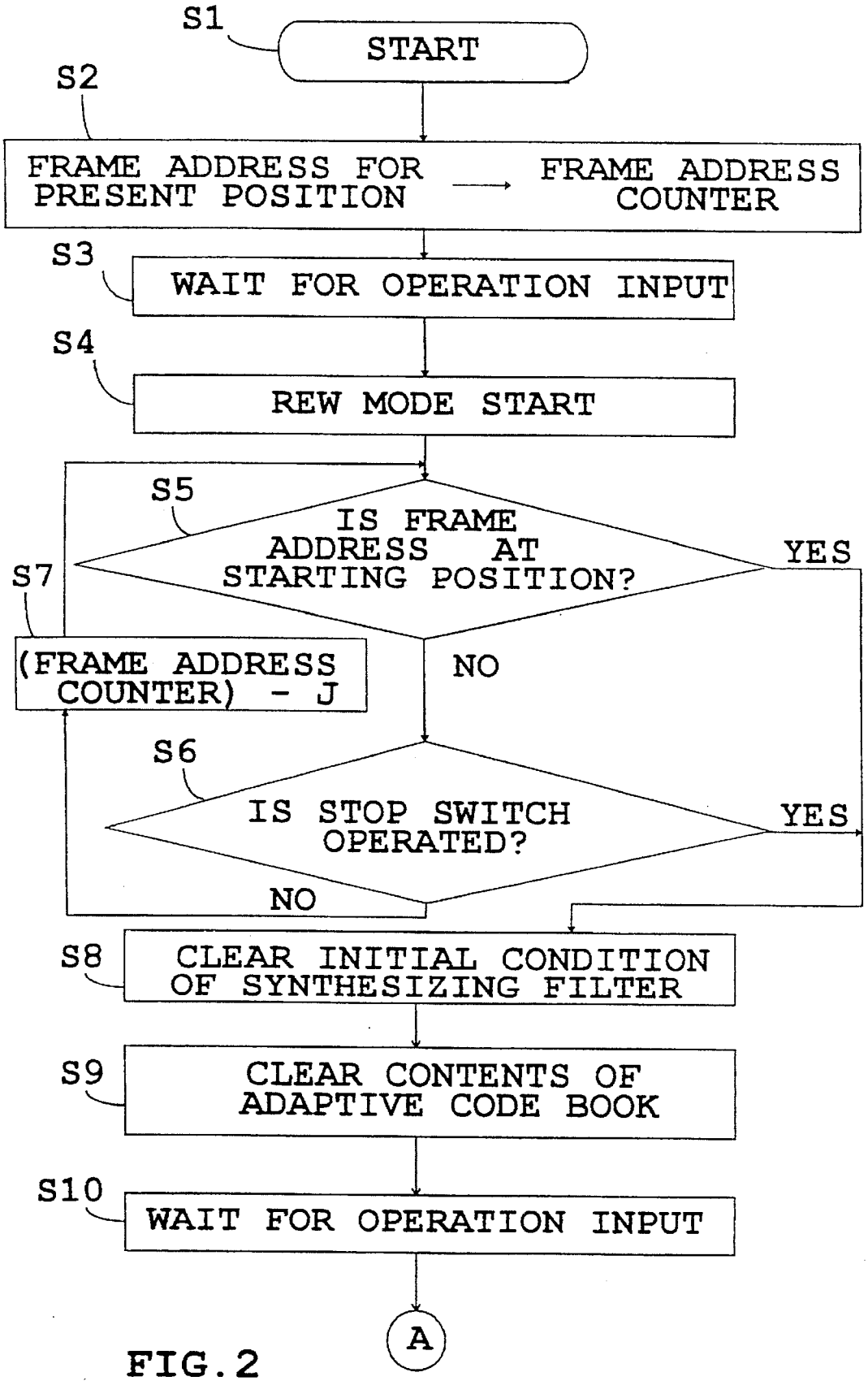
FIG. 2 is a first part of a flow chart illustrating the operation of a system controller according to an embodiment of the present invention.

In FIG. 2, step S1 shows a state after turning on the power source, completing a stop operation or the like. In step S2, a frame address which shows the present position is set to the frame address counter 14 by the system controller 12 based on the used conditions of the sound memory 7, after which a next input operation is awaited in step S3. When the user pushes the button of the REW mode at an input operation part 13 in step S4, the operation of the REW mode is performed in steps S5 through S7. In step S5, it is examined whether the frame address is at a starting position of the sound data or not. In step S6, it is examined whether a stop operation is completed or not. When both of the examinations in steps S5 and S6 turn out to be negative, a predetermined value j, for example j=10, is reduced from the value of the frame address counter 14 in step S7. The operation in step S7 is then repeated. In this way, the operation of the REW mode is carried out by reducing the predetermined value j from the address counter 14 till the frame address reaches the starting position of the sound data or the stop operation is performed.

When the examinations in steps S5 and S6 turn out to be positive, the initial conditions of the synthesizing filter 56 and the contents of the adaptive code book 51 are cleared in steps S8 and S9. In step S10, while maintaining the value of the frame address 14, an input operation is awaited. The operations in steps S8 and S9 prevent the sound quality from becoming poor because of, for example, a strange sound caused by the influence of the excitation signal immediately before the REW mode operation just performed.

Figure 3:
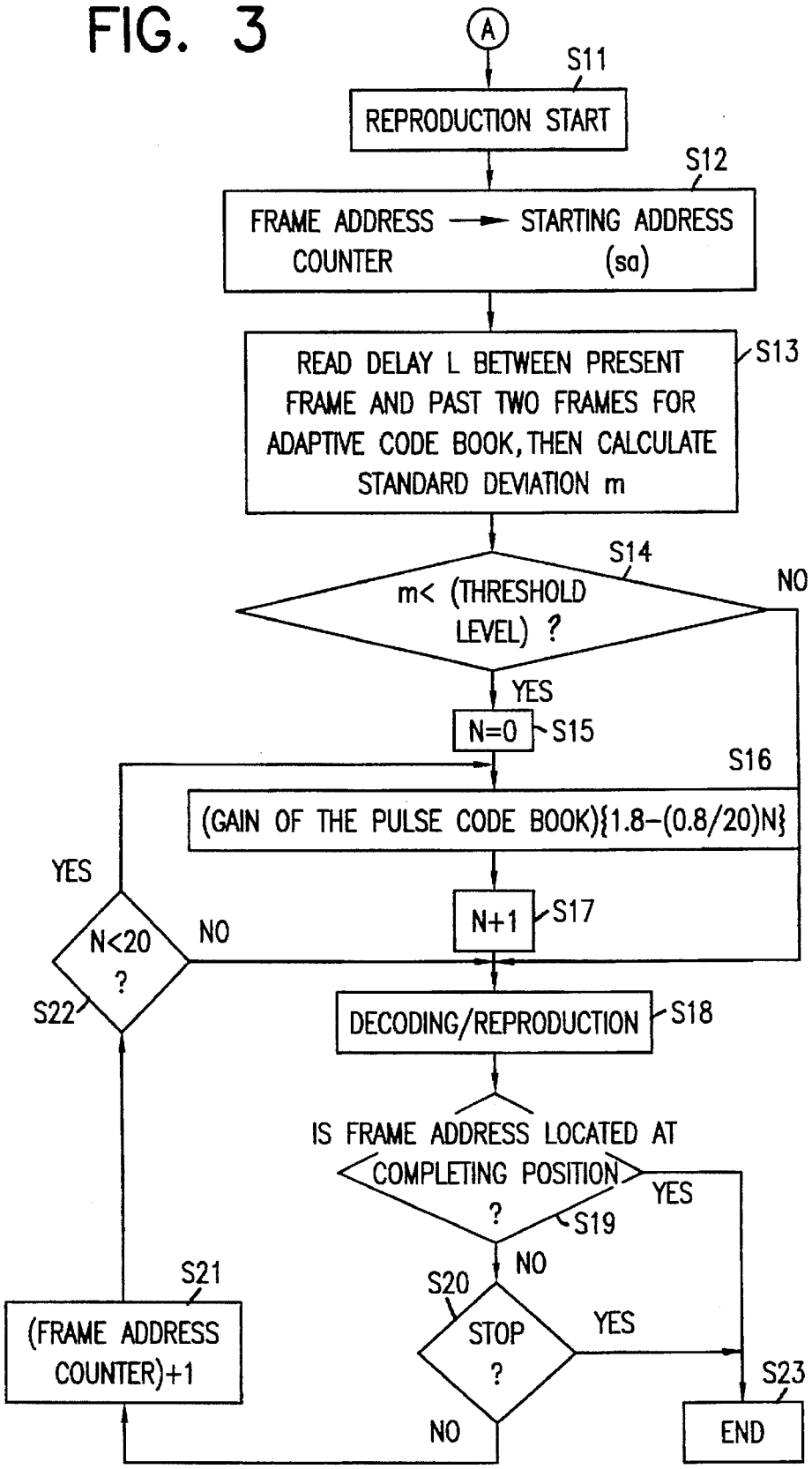
FIG. 3 is a second part of a flow chart illustrating the operation of a system controller according to an embodiment of the present invention.

In step S11, in FIG. 3, when the user pushes the reproduction button in the input operation part 13, the present value of the frame address counter 14 is stored as a starting address (sa) in step S12. In and after step S13, depending on whether the sound at the position indicated by the starting address is a constant voiced sound or an inconstant unvoiced sound, the gain value of the pulse code book 40 is manipulated to perform the decoding and reproduction. For example, the delay L of the adaptive code book 35 for three frames, that is 12 sub-frames, the present frame and two past frames is read and its standard deviation value m is calculated. This operation is for determining whether the standard deviation value exceeds a threshold value or not by using the fact that the delay L of the adaptive code book varies narrowly when the sound is a constant voiced sound and the delay L of the adaptive code book varies widely when the sound is an inconstant unvoiced sound or there is no sound. In step S14, it is determined whether the calculated standard deviation is smaller than the threshold value or not. If the answer is no, the sound is determined to be an unvoiced sound or no sound and the operation proceeds to step S18. If the answer is yes, the sound is determined to be a voiced sound and the operation in step S15 is performed. In step S15, a sub-frame counter N is set to be 0. In a step S16, the gain θ of the pulse code book is amplified by the following equation:

$$\theta'=\theta\{1.8-(0.8/10)N\}$$

where θ is the gain of the pulse code book after being amplified.

Figure 7:
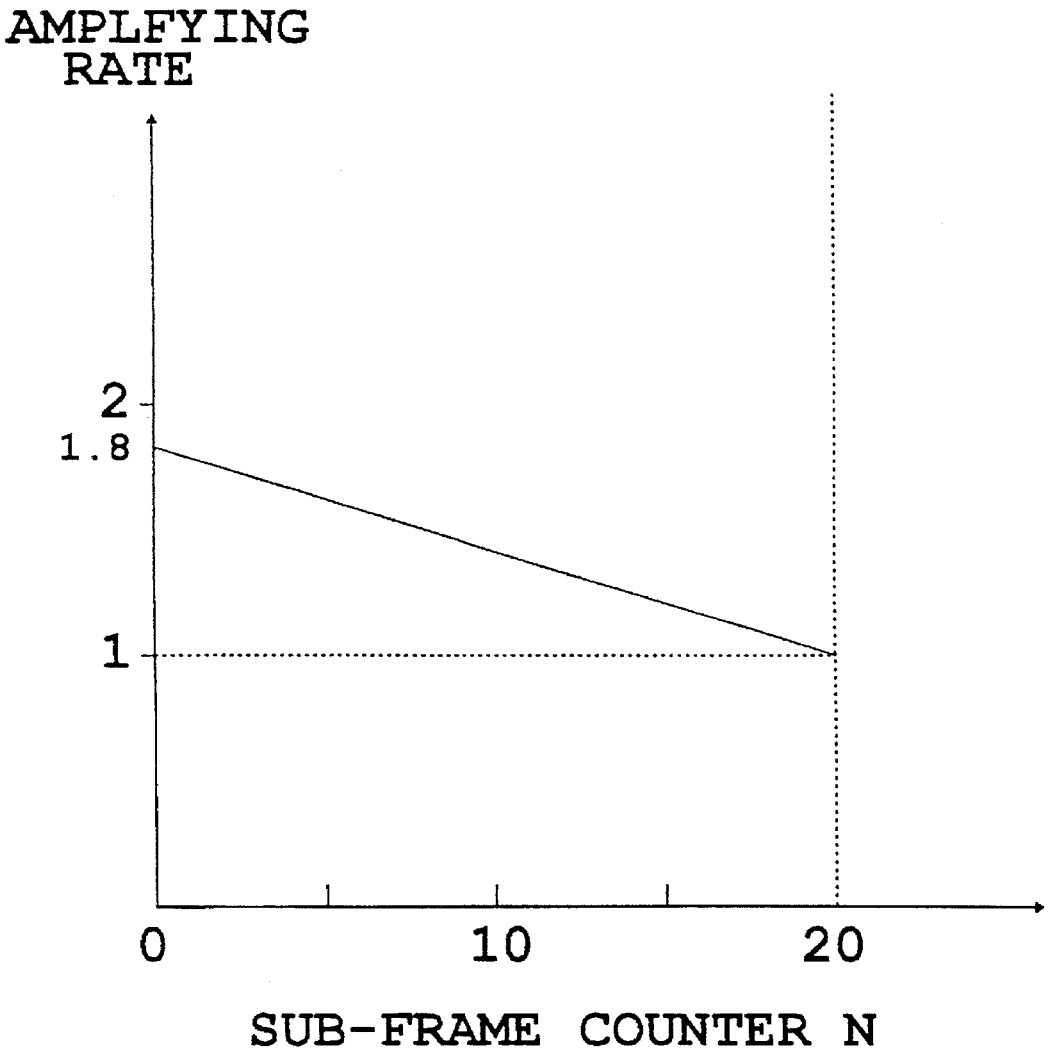
FIG. 7 is an illustration which shows a variation of amplifying rate in accordance with a sub-frame position.

The above equation shows that the amplifying rate is changed with the position of the sub-frame as shown in FIG. 7. The value which is obtained from the above equation is evaluated by an experiment which has demonstrated that at least about 100 ms, that is 5 frames (20 sub-frames) is necessary for the contents of the adaptive code book 35, to recover to follow the sound at a desired reproduction point.

In step S17, the number of the sub-frame counter is increased by 1. In step S18, the coded sound signal is decoded and reproduced. In step S19, it is determined whether the present value of the frame address counter 14 is equal to the value at the end position of the sound data or not. If it is not equal, the operation proceeds to step S20 and it is determined whether the operation of stop is performed or not. If it is not performed, the operation proceeds to step S21 where the value 1 is added to the frame address counter 14 and the operation of step S22 is performed. In step S22, it is determined whether the value N of the address counter 14 is smaller than 20 or not. If it is smaller, the operation of step S16 is repeated. If it is not smaller, operation proceeds to step S18. In this way, the decoding process is repeatedly carried out by adding the value 1 to the value of the frame address counter 14 until the value of the frame address counter 14 is equal to the value of the complete position of the sound data, or until the operation of stop is performed. When the value N of the sub-frame counter is smaller than 20, the gain of the pulse code book 40 is amplified for decoding.

In the digital information recording and reproducing device, since the pulse code book is newly provided, the periodicity of the voiced sound can be created by the pulse signal of the pulse code book even though the contents of the adaptive code book are cleared by the operation of reproduction at any intermediate position, and the sound reproduction in high quality can be performed.

Further, since the pulse code book is created by a single impulse or a sequence of impulses which have the delay intervals obtained by the search of the adaptive code book, the pulse signal for creating the periodicity of the voiced sound can be obtained by a small amount of information and a simple operation.

Furthermore, the reproduced sound becomes much more clear, since it is determined by using the recording data whether the reproduction sound at a desired reproduction point is a constant voiced sound or not and if it is a voiced sound, the gain of the pulse code book is amplified at a predetermined rate, so that the pulse signal to form the periodicity of the voiced sound can be emphasized.

Moreover, the determination of whether the sound is a constant voiced sound or not can be made by a small number of calculations since the determination is made by using only the coded parameters, utilizing the threshold determination for the standard deviation of the adaptive code book for the frame at a desired reproduced position and a predetermined number of forward and backward frames.

In this embodiment, the amplifying rate of the gain of the pulse code book is set by the above mentioned equation. However, other methods may also be applied if the similar effect can be obtained.

Also, in this embodiment, only the amplifying rate of the gain of the pulse code book is set by the above equation. However, it is possible to set simultaneously the amplifying rate of the gain of the stochastic code book.

Moreover, in this embodiment, the operation is described for the case in which the REW mode is carried out and stopped at an arbitrary position and then the sound reproduction is performed by the user. It is needless to say that the procedure of the operation for the REW mode can apply to the FF mode or the like.

Figure 8:
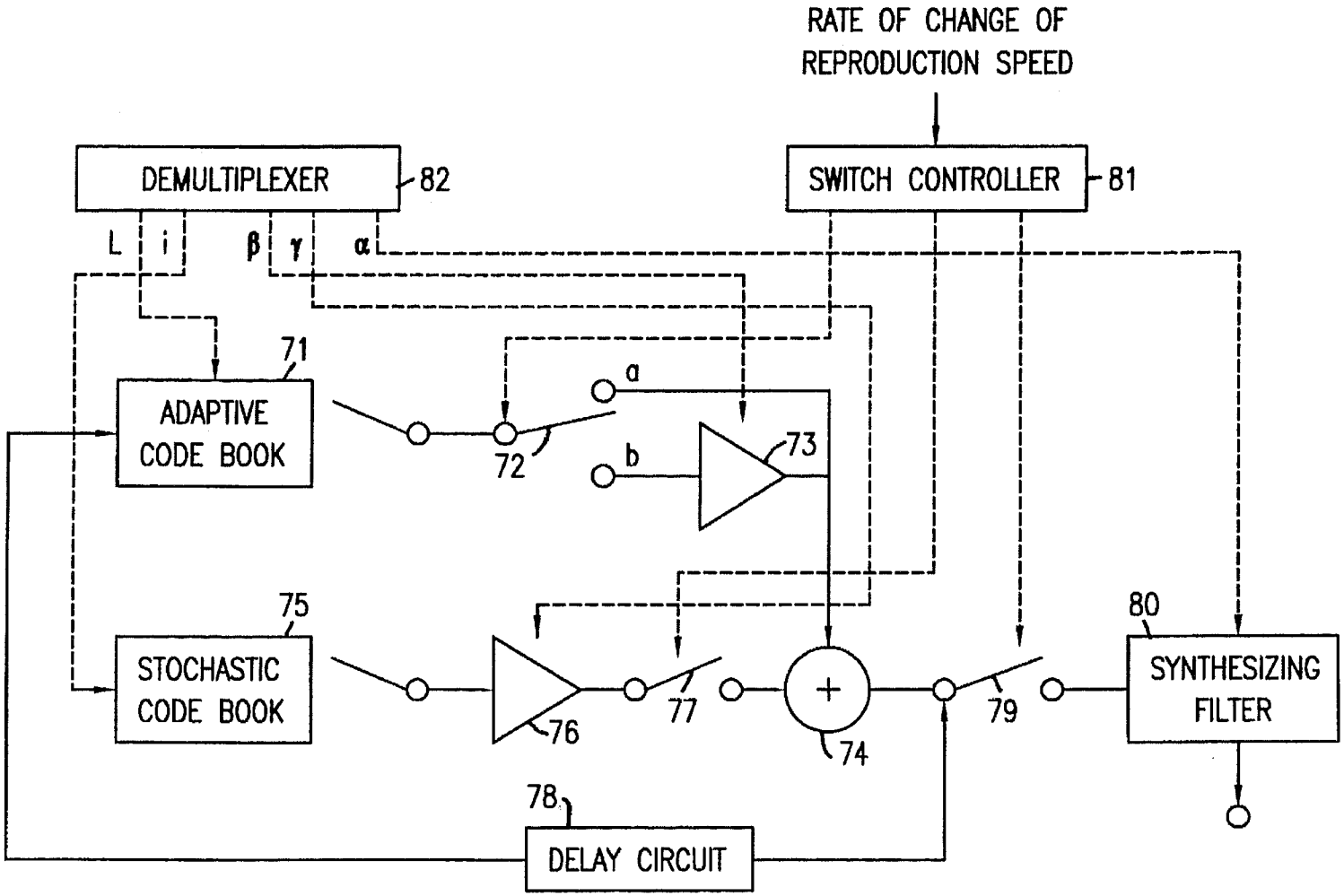
FIG. 8 is a block diagram which shows a structure of a decoding part according to the embodiment.

An embodiment of the present invention for changing the speed of sound reproduction will now be described. FIG. 8 is a block diagram which shows a structure of the decoding part for this embodiment in the coding/decoding part 5 in FIG. 1. This part performs sound decoding corresponding to code excited linear predictive coding.

In FIG. 8, an adaptive code book 71 is connected to a switch 72. A contact a of the switch 72 is connected to a first input terminal of an adder 74. A contact b of the switch 72 is coupled to the first input terminal of the adder 74 through a multiplier 73. A stochastic code book 75 is coupled to a second input terminal of the adder 74 through a multiplier 76 and a switch 77. An output terminal of the adder 74 is coupled to the adaptive code book 71 through a delay circuit 78, and is coupled to a synthesizing filter 80 through a switch 79.

A demultiplexer 82 is connected with the adaptive code book 71, the stochastic code book 75, the multipliers 73 and 76, and the synthesizing filter 80 switch controller 81 has an input terminal for receiving a control signal for the rate of the change of the sound reproduction speed from the system controller 12 and is connected with the switches 72, 77 and In the above described structure, the demultiplexer 82 decomposes the received coded data into a parameter $\alpha$ of linear prediction, an index L of the adaptive code book, a gain $\beta$ of the adaptive code an index i of the stochastic code book and a gain $\gamma$ of the stochastic code book. The decomposed parameter $\alpha$ of the linear predictor is output to the synthesizing filter 80. The decomposed index L of the adaptive code book is output to the adaptive code book 71. The decoded gain $\beta$ of the adaptive code book is output to the multiplier 73. The decomposed index i of the stochastic code book is output to the stochastic code book 75. The decomposed gain $\gamma$ of the stochastic code book is output to the multiplier 76.

Based on the index L of the adaptive code book which was output from the demultiplexer 82, an adaptive code vector is selected from the adaptive code book to which a past excitation signal obtained by delaying in the delay circuit 78 an input signal to the synthesizing filter 80 is input. The selected adaptive code vector is transmitted through the switch 72 to the adder 74 after being amplified by the gain $\beta$ of the adaptive code book which was received by the multiplier 73.

Based on the index i of the stochastic code book which is output from the demultiplexer 82, a code vector of the stochastic code book 75 is selected. The selected code vector is output to the multiplier 76. The input code vector is amplified by the received gain $\gamma$ of the stochastic code book at the multiplier 76 and then transmitted to the adder 74 through the switch 77.

The synthesizing filter 80 carries out a synthesizing process using the received parameter $\alpha$ of linear prediction as a coefficient and obtains a synthesized signal. As described below, the switch controller 81 controls the operations of the switches 72, 77 and 79 in accordance with the rate of change of the reproduction speed.

Below are described, the decoding procedures when the operator changes the reproduction speed.

First, the procedure to make the reproduction speed faster than the normal speed is described.

Figure 9:
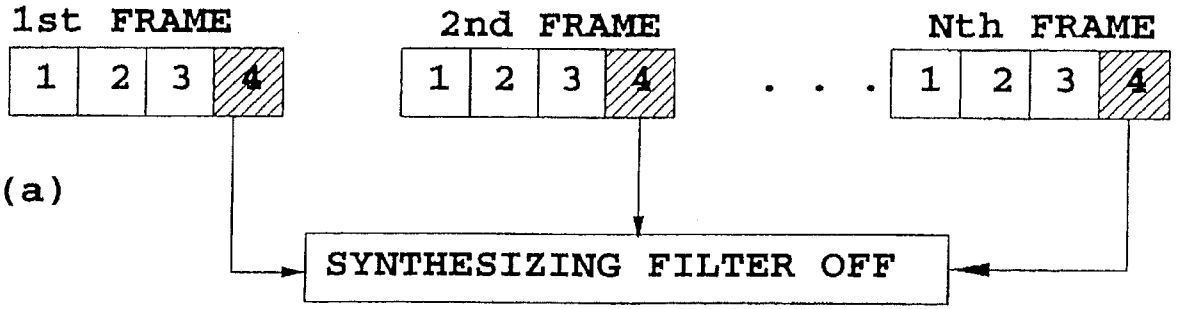
FIG. 9(*a*) is an illustration which shows a structure of each frame.
Figure 9:
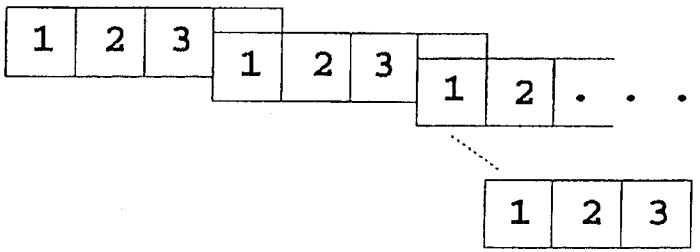
Figure 9:
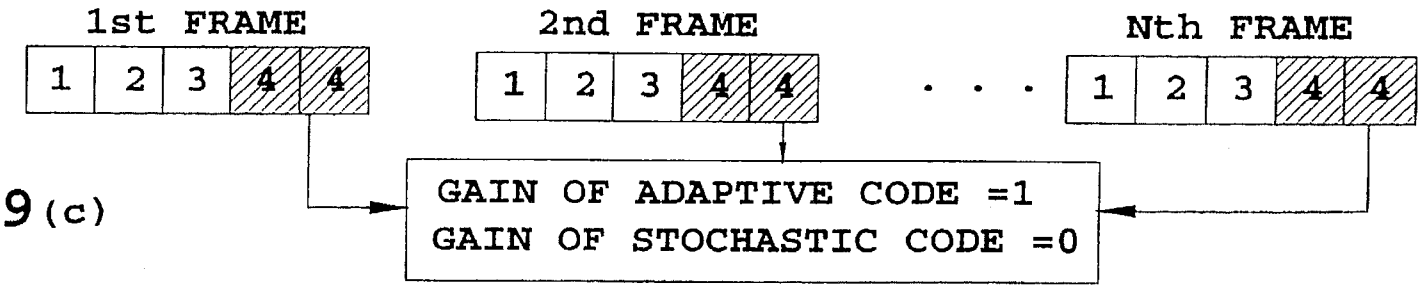

As shown in FIG. 9(*a*), in this embodiment, a signal of one frame is comprised of four sub-frames. Each sub-frame is given a sequential number. As described above, each sub-frame has received as coded data the parameter $\alpha$ of linear prediction, the index L of the adaptive code book, the gain $\beta$ of the adaptive code book, the index i of the stochastic code book and the gain $\gamma$ of the stochastic code book from the demultiplexer 32.

When the reproduction speed is made faster than the normal speed, for example 4/3 times, the switch controller 81 receives a control signal for the rate of change of the reproduction speed from the system controller 12 and, for example, as shown in FIG. 10(*a*), controls the switches such that the switch 72 is closed on the side of contact b, the switch 77 remains on, and the switch 79 is turned off only for the 4th sub-frame. Therefore, the synthesizing filter 80 does not operate for the 4th sub-frame among four sub-frames. Hence, its coded data is skipped and no decoded signal is created, but an excitation signal is created and the contents of the adaptive code book 71 are then renewed.

That is, as shown in FIG. 9(*b*), in each frame, after the decoded signal in the 3rd sub-frame is created, the decoded signal in the 1st sub-frame of the next frame is created in the 4th sub-frame. Since the contents of the adaptive code book 71 is renewed for the 4th sub-frame and the signal in the 3rd sub-frame is held in the synthesizing filter 80, the continuity of the decoded signal on the frame boundary can be maintained.

Second, the procedure to make the reproduction speed slower than the normal speed is described.

When the reproduction speed is made slower than the normal speed, for example, 4/5 times, the coded data in the 4th sub-frame among 4 sub-frames is repeatedly read as shown in FIG. 10(*b*). When the coded data in the 4th sub-frame is decoded at the second time, the switch controller 81 controls the switches such that the switch 72 is closed on the side of contact a, the switch 77 is turned off, and the switch 79 remains on. Thus, when the coded data in the 4th sub-frame is decoded at the second time, the gain $\beta$ of the adaptive code book becomes 1 and the gain $\gamma$ of the stochastic code book becomes 0.

That is, as shown in FIG. 9(*c*), in each frame, after the decoded signal of the 4th sub-frame, the same decoded signal is created again. At that time, the gain $\beta$ of the adaptive code book is 1 and the gain $\gamma$ of the stochastic code book is 0. Thus, the contents of the adaptive code book renewed when decoding the coded data of the 4th sub-frame at the second time have the same gain as do the contents in the adaptive code book renewed at the first time of decoding, so that the continuity of the decoded signal on the frame boundary can be maintained.

FIG. 11 shows the sub-frames whose coded data are skipped or repeatedly read out in accordance with the rate of change of the reproduction speed when a frame is comprised of four sub-frames.

As can be seen from FIG. 11, for example, when the rate of change of the speed is doubled, the coded data in the last two sub-frames are skipped. When the rate of change of the speed change is halved (that is, 4/8), the coded data in all the four sub-frames are repeatedly read.

In the above embodiment, one frame comprises four sub-frames. When the reproduction speed is increased, the coded data in the 4th sub-frame is skipped, and when the reproduction speed is decreased, the coded data in the 4th sub-frame is repeatedly read out. However, the present invention is not limited to this embodiment. The constitution of one frame may be changed and the sub-frames whose data are skipped or repeatedly read out may be determined according to circumstances.

In the above described embodiment, since the contents of the adaptive code book or the synthesizing filter maintain the continuity of the decoded signal on the boundary of the frames or the sub-frames, the sound reproduction speed can be changed with a natural interval maintained by reducing the deterioration of the quality of sound due to the discontinuity of the signal. Moreover, since the above described decoding processing can be made only by switch control, the sound reproduction speed can be changed with a natural interval maintained only by making a few modifications on a conventional sound decoding device.

I claim:

1. A sound recording and reproducing device comprising:

an adaptive code book which is created by past excitation signals;

a stochastic code book having a plurality of different stochastic signals;

a pulse code book having a plurality of different pulse signals;

a code excited linear predictive coder for coding a sound data frame-by-frame by using said adaptive code book, said stochastic code book and said pulse code book;

a memory for storing the coded sound data as a coded data; and a code excited linear predictive decoder for decoding said coded data.

2. The device according to claim 1, wherein said pulse code book is created based on a single impulse or a sequence of impulses having a delay interval determined by a search of the adaptive code book.

3. The device according to claim 1, further comprising a controller for determining, when sound is started to be reproduced at an intermediate position, whether the sound at a reproduction point is a constant voiced sound, based on said coded data stored in said memory means, and for amplifying a gain of said pulse code book at a predetermined rate if the sound is a voiced sound.

4. The device according to claim 3, wherein the controller determines whether the sound at the reproduction point is a constant voiced sound by comparing to a threshold a standard deviation of delays of the adaptive code book for a frame at the reproduction point and a predetermined number of frames in front of and behind the frame at the reproduction point.

5. A sound reproduction device comprising:

a code excited linear predictive decoder for decoding a coded data which is a sound data coded frame-by-frame by code excited linear predictive coding, each frame comprising a plurality of sub-frames, by using an adaptive code book created on the basis of past excitation signals and a stochastic code book having a plurality of different stochastic signals; and a controller for skipping the coded data in a predetermined sub-frame of each frame in accordance with a rate of change of reproduction speed to decode the coded data in the remaining sub-frame or sub-frames by said code excited linear predictive decoder without decoding the coded data in the skipped sub-frame, and for renewing the contents of the adaptive code book, when the reproduction speed is increased.

6. The device according to claim 5, wherein the coded data in the last sub-frame or in a series of sub-frames including at least the last sub-frame of each frame is skipped.

7. The device according to claim 6, wherein when the reproduction speed is decreased, said controller repeatedly reads the coded data in a predetermined sub-frame of each frame in accordance with the rate of change of the reproduction speed to decode the coded data by said code excited linear predictive decoder and renews the contents of said adaptive code book with a gain of 1 of said adaptive code book and a gain of 0 of said stochastic code book.

8. A sound reproduction device comprising:

a code excited linear predictive decoder for decoding a coded sound data, which is coded frame-by-frame by code excited linear predictive coding with each frame comprising a plurality of sub-frames, by using an adaptive code book created on past excitation signals and a stochastic code book having a plurality of different stochastic signals; and a controller for repeatedly reading the coded data in a predetermined sub-frame of each frame in accordance with the rate of change of reproduction speed to decode the coded data by said code excited linear predictive decoder, and for renewing the contents of said adaptive code book with a gain of 1 of said adaptive code book and a gain of 0 of said stochastic code book.

9. The device according to claim 8, wherein the coded data in the last sub-frame or in a series of sub-frames including at least the last sub-frame of each frame is read repeatedly.

10. The device according to claim 8, wherein said controller includes a switch to select the gain of the adaptive code book, a switch to select the gain of the stochastic code book, a switch to select a synthesized output of the gain-controlled adaptive code book and the stochastic code book, and a switch controller to control said switches.

* * * * *